US006977616B2

(12) United States Patent
Yuanzhu

(10) Patent No.: US 6,977,616 B2
(45) Date of Patent: Dec. 20, 2005

(54) DUAL-BAND ANTENNA HAVING SMALL SIZE AND LOW-HEIGHT

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/925,409

(22) Filed: Aug. 25, 2004

(65) Prior Publication Data

US 2005/0057400 A1 Mar. 17, 2005

(30) Foreign Application Priority Data

Sep. 1, 2003 (JP) ..... 2003-308713
Sep. 22, 2003 (JP) ..... 2003-330088

(51) Int. Cl.[7] ..... H01Q 1/38
(52) U.S. Cl. ..... 343/700 MS; 343/846
(58) Field of Search ..... 343/700 MS, 846, 343/702, 848; H01Q 1/38

(56) References Cited

U.S. PATENT DOCUMENTS

| | | | | |
|---|---|---|---|---|
| 6,008,764 | A * | 12/1999 | Ollikainen et al. | 343/700 MS |
| 6,650,294 | B2 * | 11/2003 | Ying et al. | 343/700 MS |
| 2004/0125033 | A1 * | 7/2004 | Yuanzhu | 343/702 |
| 2004/0263400 | A1 * | 12/2004 | Yuanzhu | 343/702 |
| 2005/0057416 | A1 * | 3/2005 | Yuanzhu | 343/795 |

FOREIGN PATENT DOCUMENTS

| | | |
|---|---|---|
| JP | H10-093332 | 4/1998 |
| JP | 2003-101336 | 4/2003 |

* cited by examiner

*Primary Examiner*—Hoanganh Le
(74) *Attorney, Agent, or Firm*—Brinks Hofer Gilson & Lione

(57) ABSTRACT

There is provided a dual-band antenna having small size and low height which has a characteristic of not affecting a bandwidth of signal waves of a low band in its miniaturized state. In a dual-band antenna 11, a first radiating conductive plate 13 is arranged to oppose a surface of a grounding conductor 12 in an approximately parallel manner, being excited at a first frequency. A feeding conductive plate 14 extends approximately orthogonally from an outer edge of the first radiating conductive plate 13 and is connected to a feeding circuit. A second radiating conductive plate 15 is stood downward the first radiating conductive plate 13, whose lower end is connected to the feeding conductive plate 14. The second radiating conductive plate 15 is excited at a second frequency. A third radiating conductive plate 17 is arranged to oppose the surface of the grounding conductor 12 in an approximately parallel manner on a surface of the grounding conductor and to be adjacent to the first radiating conductive plate 13. A slit 18 is interposed between both radiating conductive plates 13 and 17. A shorting conductive plate 19 extends approximately orthogonally from an outer edge of the third radiating conductive plate 17 and is connected to the surface of the grounding conductor 12. The feeding conductive plate 14 and the shorting conductive plate 19 is arranged close to each other, such that, when a power is supplied, the feeding conductive plate 14 and the shorting conductive plate 19 is electromagnetically coupled.

6 Claims, 5 Drawing Sheets

DUAL-BAND ANTENNA HAVING SMALL SIZE AND LOW-HEIGHT

This application claims the benefit of priority to Japanese Patent Application No. 2003-308713 filed on Sep. 1, 2003 and 2003-330088 filed on Sep. 22, 2003, herein incorporated by reference.

BACKGROUND OF THE INVENTION

1. Field of the Invention

The present invention relates to a dual-band antenna having small size and low height which is capable of transmitting and receiving respective signal waves of high and low frequency bands, and which is suitable for using as a vehicle antenna or a portable antenna.

2. Descriptions of the Related Art

As an antenna having a suitable small size and low height, an inverted F type antenna has been suggested, in which a notch is provided in a radiating conductive plate such that the radiating conductive plate is excited in two types of high and low frequency bands (for example, see Japanese Unexamined Patent Application Publication No. 10-93332, pages 2 to 3, FIG. 1).

FIG. 10 is a perspective view of a conventional inverted F type dual-band antenna. In the inverted F type dual-band antenna 1, a radiating conductive plate 2 is arranged to oppose a surface of a grounding conductor 5 in an approximately parallel manner, and a shorting conductive plate 3 extends approximately orthogonally from an outer edge of the radiating conductive plate 2. The radiating conductive plate 2 has a L-shaped conductor piece 2*a* which is excited at a first frequency $f_1$, a rectangular conductor piece 2*b* which is excited at a second frequency $f_2$ higher than the first frequency $f_1$, and a rectangular notch 4. A lower end of the shorting conductive plate 3 is connected to the surface of the grounding conductor 5. Further, to a predetermined position of the radiating conductive plate 2, a feeding pin 6 is connected by means of soldering, and a lower end of the feeding pin 6 is connected to a feeding circuit (not shown) without contacting the surface of the grounding conductor 5.

In the conventional dual-band antenna 1 having such a schematic configuration, the length along an extended direction of the L-shaped conductor piece 2*a* is set to be about a quarter of a resonant length $\lambda_1$ corresponding to the first frequency $f_1$, and the length of the rectangular conductor piece 2*b* is set to be about a quarter of a resonant length $\lambda_2$ corresponding to the second Frequency $f_2$ (but $\lambda_2<\lambda_1$). Therefore, by selectively supplying high frequency powers corresponding to two types of high and low frequency bands (high band and low band) to the radiating conductive plate 2 via the feeding pin 6, it is possible to allow the respective conductor pieces 2*a* and 2*b* to be excited at a different frequency from each other, and to transmit or receive signal waves of two types of high and low frequency bands.

Further, in such an inverted F type dual-band antenna, a technique in which a radiating conductor is formed in a meandering form is widely adopted. In such a manner, since a path of current flowing through the radiating conductor is made along the meandering form to prolong an electric field, it is possible to easily miniaturize the entire antenna.

Recently, although the miniaturization of vehicle dual-band antennas is in high demand, in the case of miniaturizing the above-mentioned conventional dual-band antenna 1, there is a problem in that a desired bandwidth cannot be secured when using the low band, since antenna devices generally have a feature that a resonant bandwidth is typically narrowed due to the miniaturization. In particular, the resonant bandwidth tends to be narrowed in the case of the low band in which the resonant length is long. Here, the bandwidth is a frequency range at which a return loss (the amount of reflection attenuation) is less than −10 dB, and the dual-band antenna must secure a bandwidth wider than an using frequency band with respect to the respective waves of the high band and the low band, which results in obstructing the miniaturization.

Further, in the case in which the radiating conductor for the low band is formed in the meandering form in an effort to miniaturize the dual-band antenna, a reverse current is generated at a close range in a way of a current path of the radiating conductor, and an electric field due to the reverse current is easily offset, such that the radiation efficiency is unavoidably lowered. In addition, since the antenna device generally has a narrower bandwidth following the miniaturization along with lowered radiation efficiency, it is difficult to secure a desired bandwidth if the miniaturization of the dual-band antenna is implemented by making the radiating conductor in the meandering form.

In addition, in the conventional dual-band antenna 1, electric waves having a polarized wave direction parallel to the radiating conductive plate 2 (for example, horizontal polarized wave), as well as electric waves having a polarized wave direction orthogonal to the radiating conductive plate 2 (for example, vertical polarized wave), are radiated, such that the uniformity of polarized wave is lowered. Therefore, gains of electric waves of a specific polarized wave direction are proportionally lowered, which results in a problem in that it is difficult to obtain a high gain.

SUMMARY OF THE INVENTION

The present invention has been made in consideration of the above problems, and it is an object of the present invention to provide a dual-band antenna which is capable of being miniaturized without affecting bandwidths of signal waves of a low band, and which is suitable for a vehicle antenna in which gains to electric waves of a specific polarized wave direction are high.

In order to achieve the above-mentioned objects, a dual-band antenna of the present invention comprises a first radiating conductive plate arranged to oppose a grounding conductor on a surface of the grounding conductor in an approximately parallel manner, the first radiating conductive plate being excited at a first frequency; a feeding conductive plate extending approximately orthogonally from an outer edge of the first radiating conductive plate and connected to a feeding circuit; a second radiating conductive plate extending in approximately parallel to the feeding conductive plate, whose lower end is connected to the feeding conductive plate and an upper end opposes a bottom surface of the first radiating conductive plate; a third radiating conductive plate arranged to oppose a grounding conductor in an approximately parallel manner on a surface of the grounding conductor, the third radiating conductive plate being adjacent to the first radiating conductive plate with a slit interposed therebetween; and a first shorting conductive plate extending approximately orthogonally from an outer edge of the third radiating conductive plate and connected to the surface of the grounding conductor. The second radiating conductive plate is excited at a second frequency which is higher than the first frequency, and the first shorting conductive plate is arranged close to the feeding conductive plate such that the first shorting conductive plate is electromagnetically coupled to the feeding conductive plate.

In such a dual-band antenna, it is possible to excite the first radiating conductive plate by supplying a high frequency power of the first frequency for a low band to the lower end of the feeding conductive plate, and it is possible to excite the second radiating conductive plate by supplying a high frequency power of the second frequency for a high band to the lower end of the second radiating conductive plate. Further, when the high frequency power is supplied to the feeding conductive plate, it is possible to allow the third radiating conductive plate to be operated as an radiating element of a parasitic antenna since an induced current flows through the first shorting conductive plate electromagnetically coupled to the feeding conductive plate, and further it is possible to set two resonance points in the low band. In addition, the difference of resonant frequencies of two resonance points can be increased or decreased by suitably adjusting the degree of the electromagnetic coupling between the feeding conductive plate and the first shorting conductive plate, such that, even when an antenna is made to have a small size and low height, it becomes easy to secure a desired bandwidth by widening a frequency range in which a return loss is less than a predetermined value. Further, in the dual-band antenna, since the upper end of the second radiating conductive plate opposes the bottom surface of the first radiating conductive plate, the first radiating conductive plate functions as a capacitive load to reduce an electric field when the second radiating conductive plate is supplied with the high frequency power of the second frequency to be resonated. Accordingly, it is possible to reduce drastically a height of the second radiating conductive plate less than a quarter of a resonant length.

In such a dual-band antenna, the feeding conductive plate may extend from the outer edge the first radiating conductive plate adjacent to the slit, and the first shorting conductive plate may extend from the outer edge of the third radiating conductive plate adjacent to the slit. Accordingly, it becomes easy to electromagnetically couple the feeding conductive plate and the first shorting conductive plate.

Moreover, such a dual-band antenna may comprise a matching shorting conductive plate which extends approximately orthogonally from the outer edge of the first radiating conductive plate and is connected to the surface of the grounding conductor. In this case, it becomes easy to prevent impedance mismatching when using the low band by suitably selecting a forming position of the matching shorting conductive plate. Therefore, it is possible to decrease a height of an entire antenna further.

Further, in order to achieve the above-mentioned object, a dual-band antenna of the present invention comprises a cylindrical insulating base member mounted on a supporting substrate having a grounding conductor, a fourth radiating conductive plate including a pair of divided conductive plates provided in parallel to a slit interposed therebetween and mounted at positions covering opening ends of the insulating base member, a feeding conductive plate and a second shorting conductive plate provided in an inner space of the insulating base member, whose upper ends are respectively connected to an outer edge of one divided conductive plate of the pair of divided conductive plates adjacent to the slit, a third shorting conductive plate provided in the inner space of the insulating base member, whose upper end is connected to an outer edge of the other divided conductive plate of the pair of divided conductive plates adjacent to the slit, and a fifth radiating conductive plate provided in the inner space of the insulating base member, whose lower end is connected to the feeding conductive plate and the height is lower than that of the fourth radiating conductive plate. A lower end of the feeding conductive plate is connected to a feeding circuit and lower ends of the second and third shorting conductive plates are connected to the grounding conductor, such that in a state in which the third shorting conductive plate is electromagnetically coupled to the feeding conductive plate, the fourth radiating conductive plate is resonated at a first frequency, and the fifth radiating conductive plate is resonated at a second frequency which is higher than the first frequency.

In such a dual-band antenna, if one divided conductive plate connected to an upper end of the feeding conductive plate is excited, the other divided conductive plate is excited via the third shorting conductive plate which is electromagnetically coupled to the feeding conductive plate. Thus, it is possible to allow the other divided conductive plate to be operated as a radiating element for a parasitic antenna, and also it is possible to set two different resonance points. Further, the difference of resonant frequencies of two resonance points can be increased or decreased by suitably adjusting the degree of the electromagnetic coupling between the feeding conductive plate and the third shorting conductive plate, such that, even when the antenna is miniaturized by reducing an entire size of the fourth radiating conductive plate for the low band, it becomes easy to secure a desired bandwidth by widening a frequency range in which a return loss becomes less than a predetermined value. Further, in the pair of divided conductive plates when exciting, currents having the same magnitude respectively generate to flow in an opposite direction to each other, such that an electric field in one divided conductive plate and an electric field in the other divided conductive plate cancel each other. Therefore, while electric waves having a polarized wave direction parallel to the fourth radiating conductive plate are almost never radiated, electric waves having a polarized wave direction orthogonal to the fourth radiating conductive plate are intensively radiated as much, and thus uniformity of polarized waves is raised. Therefore, it is possible to enhance drastically gains to electric waves of specific polarized waves (for example, vertical polarized waves). Moreover, since the fifth radiating conductive plate for the high band operates as a monopole antenna of ¼ wavelength when exciting, a gain of the vertical polarized wave is high, such that it is possible to suppress the height to be low.

In such a dual-band antenna, the pair of divided conductive plates may be respectively provided with windows which are the approximately same shape. In this case, since the currents which are supplied to the pair of divided conductive plates flow along circumferential edge of the windows, it becomes easy to secure a desired resonant electric field even when the respective divided conductive plates are miniaturized. Therefore, since it is not required for the respective divided conductive plates to form in a meandering shape, radiation efficiency is raised, and an effect or suppressing the narrow band due to the miniaturization is further raised.

Further, in such a dual-band antenna, the upper end of the fifth radiating conductive plate may extend in approximately parallel to the grounding conductor. In this case, since the fifth radiating conductive plate operating as the monopole antenna becomes a top-loading state, it is possible to reduce drastically the height.

According to the present invention, when using the low band in which it is difficult to secure a bandwidth due to a miniaturization, it allows the third radiating conductive plate to be operated as a radiating element of a parasitic antenna by electromagnetically coupling the shorting conductive plate and the feeding conductive plate, such that two resonance points are generated. Further, the difference of frequencies of two resonance points can be increased or decreased by suitably adjusting the degree of the electromagnetic coupling. Therefore, though a dual-band antenna is made to have a small size and low height, it becomes easy to secure a desired bandwidth when using the low band. As a result, it is possible to easily secure a wider bandwidth than an using frequency band to the respective signal waves of the high band and the low band, and further it is possible to make a dual-band antenna have small size and low height without affecting the bandwidth.

Further, according to the dual-band antenna of the present invention, if one divided conductive plate is excited, the other divided conductive plate operates as a radiating element of a parasitic antenna, such that it becomes easy to secure a desired bandwidth even when the miniaturization is implemented by reducing an entire size of the fourth radiating conductive plate for the low band. In addition, since currents having the same magnitude are generated to flow in an opposite direction to each other through the pair of divided conductive plates when exciting, electric waves having a polarized wave direction parallel to the fourth radiating conductive plate are almost never radiated, such that it is possible to raise uniformity of polarized wave, and further it is possible to drastically enhance a gain to a specific polarized wave direction.

Further, in such a dual-band antenna, the pair of divided conductive plates is respectively provided with the windows having the approximately same shape, such that it becomes easy to secure a required resonant electric field even when the respective divided conductive plates are miniaturized. Therefore, since it is not required for the respective divided conductive plates to have a meandering shape, the radiation efficiency is raised, and also an effect of suppressing the narrow band due to the miniaturization is further raised.

DESCRIPTION OF THE EMBODIMENTS

Figure 1:
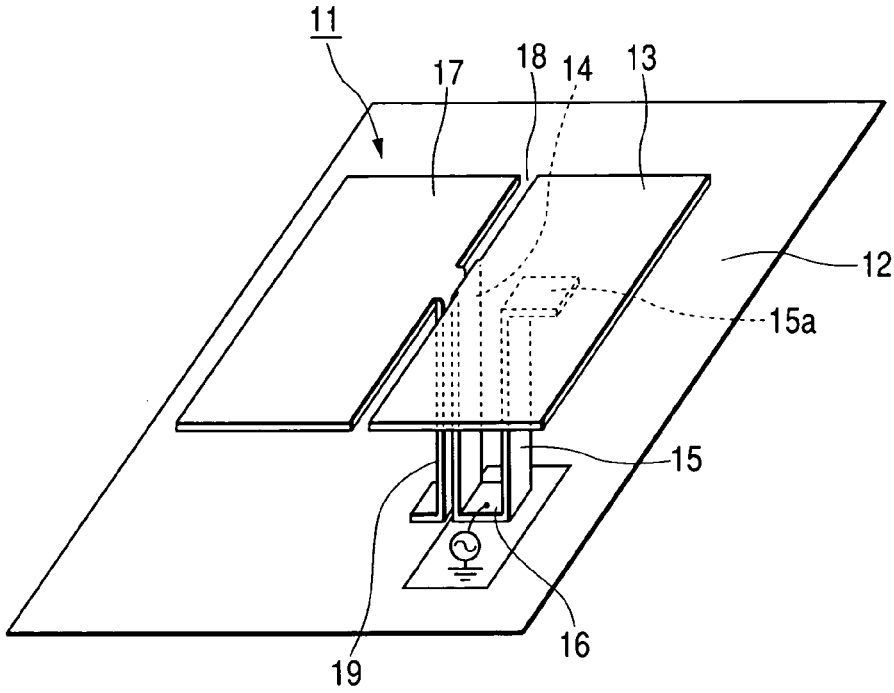
FIG. 1 is a perspective view showing a dual-band antenna according to a first embodiment of the present invention.

Embodiments of the present invention will now be described with reference to the drawings. FIG. 1 is a perspective view of a dual-band antenna according to a first embodiment of the present invention, FIG. 2 is a partial cross-sectional side view of the dual-band antenna, and FIG. 3 is a characteristic view showing a return loss according to frequencies of the dual-band antenna.

Figure 2:
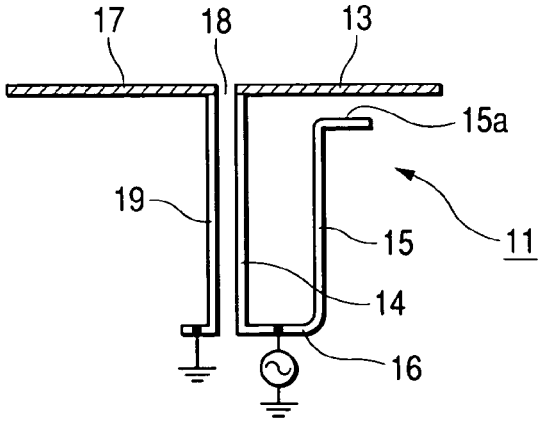
FIG. 2 is a partial cross-sectional side view of the dual-band antenna.
Figure 3:
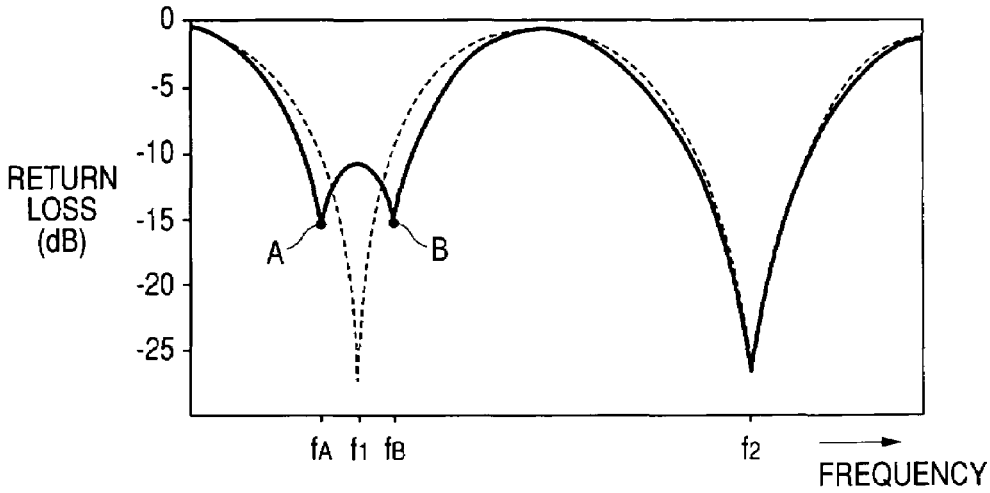
FIG. 3 is a characteristic view showing a return loss of the dual-band antenna.

A dual-band antenna 11 shown in FIGS. 1 and 2 is a metallic plate product by bending a conductive metallic plate such as a copper plate and is fixedly provided on a surface of a grounding conductor 12. The dual-band antenna 11 schematically comprises a first radiating conductive plate 13 arranged to oppose the surface of the grounding conductor 12 in an approximately parallel manner, a feeding conductive plate 14 extending approximately orthogonally from an outer edge of the first radiating conductive plate 13, a second radiating conductive plate 15 approximately parallel to the feeding conductive plate below an approximate center of the first radiating conductive plate 13, a bridge portion 16 connecting lower ends of the feeding conductive plate 14 and the second radiating conductive plate 15, a third radiating conductive plate 17 arranged to oppose the surface of the grounding conductor 12 in an approximately parallel manner to be adjacent to the first radiating conductive plate 13, a slit 18 interposed between the first and third radiating conductive plates 13 and 17, and a first shorting conductive plate 19 extending approximately orthogonally from an outer edge of the third radiating conductive plate 17.

The first radiating conductive plate 13 and the third radiating conductive plate 17 have almost the same shape and are provided to be approximately linearly symmetric to the slit as a symmetric axis. In an upper end of the second radiating conductive plate 15, a bent portion 15*a* is formed and opposes to a bottom surface of the first radiating conductive plate 13 with a gap interposed therebetween. Since the bridge portion 16 is connected to a feeding circuit (not shown), it is possible to supply a predetermined high frequency power to the feeding conductive plate 14 and the second radiating conductive plate 15 respectively. The bridge portion 16, the feeding conductive plate 14 and the second radiating conductive plate 15 are arranged at a region which does not contact the surface of the grounding conductor 12, but a lower end of the first shorting conductive plate 19 is connected to the surface of the grounding conductor 12. Further, since the feeding conductive plate 14 and the first shorting conductive plate 19 are adjacent to oppose each other with the slit 18 interposed therebetween, the feeding conductive plate 14 and the first shorting conductive plate 19 have an the electromagnetic coupling that is relatively strengthened when power is supplied.

In such a dual-band antenna 11, by selectively supplying high frequency powers corresponding to two types of high and low frequency bands to the bridge portion 16, it is possible to selectively excite the first radiating conductive plate 13 and the second radiating conductive place 15. That is, by supplying a high frequency power of a first frequency $f_1$ for the low band to a lower end of the feeding conductive plate 14, it is possible to excite the first radiating conductive plate 13, and by supplying a high frequency power of a second frequency $f_2$ (but, $f_2>f_1$) for the high band to a lower end of the second radiating conductive plate 15, it is possible to excite the second radiating conductive plate 15.

Further, when the high frequency power of the first frequency $f_1$ is supplied to the feeding conductive plate 14, an induced current flows through the first shorting conductive plate 19 by means of electromagnetic coupling with the feeding conductive plate 14, such that it is possible to allow the third radiating conductive plate 17 to be operated as a radiating element of a parasitic antenna. Therefore, a return loss (amount of reflection attenuation) according to a frequency of the dual-band antenna 11 takes the shape of the solid curve in FIG. 3, in which two different resonance points A and B in the low band are generated. Here, if the electromagnetic coupling of the feeding conductive plate 14 and the first shorting conductive plate 19 are strengthened or weakened by changing relative positions of the feeding conductive plate 14 and the first shorting conductive plate 19, the resonant frequencies corresponding to the resonance points A and B are changed accordingly. Thus, if the antenna is designed such that the degree of the electromagnetic coupling of the feeding conductive plate 14 and the first shorting conductive plate 19 is suitably adjusted, a return loss at a certain frequency between a resonant frequency f(A) corresponding to the resonance point A and a resonant frequency f(B) corresponding to the resonance point B becomes less than −10 dB, and the difference of the resonant frequency f(A) and the resonant frequency f(B) is extremely enlarged, it is possible to drastically widen a bandwidth when using the low band.

Figure 10:
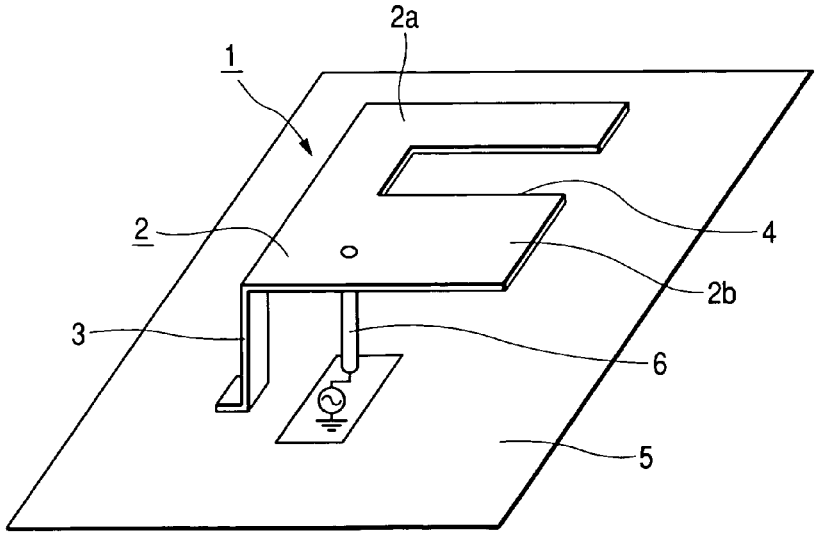
FIG. 10 PRIOR ART
FIG. 10 is an explanatory view showing a conventional inverted F type dual-band antenna.

For example, in the case in which the feeding conductive plate 14 and the first shorting conductive plate 19 are extremely close to each other, thereby strengthening the electromagnetic coupling remarkably, the resonant frequency f(A) and the resonant frequency f(B) become almost the same value, which results in narrowing the bandwidth. Meanwhile, if the feeding conductive plate 14 and the first shorting conductive plate 19 are relatively far away from each other, to thereby weaken the electromagnetic coupling, the difference of the resonant frequency f(A) and the resonant frequency f(B) is gradually increased, and also the bandwidth is widened. However, if the electromagnetic coupling of the feeding conductive plate 14 and the first shorting conductive plate 19 is overly weakened, the return loss to signal waves of a predetermined frequency between the resonant frequency f(A) and the resonant frequency f(B) exceeds −10 dB, and thus a broad band cannot be obtained accordingly. Consequently, in the case in which the resonance points A and B as shown in FIG. 3 are set by suitably adjusting the degree of the electromagnetic coupling of the feeding conductive plate 14 and the first shorting conductive plate 19, a frequency range becomes maximized when the return loss is less than −10 dB, such that it is most advantageous in the broad band. Moreover the dotted curve of FIG. 3 represents the return loss in the conventional art shown in FIG. 10. In this case, since only one resonance point exists, the bandwidth when using the low band is considerably narrowed as compared with the present embodiment.

As described above, in the dual-band antenna 11 according to the present embodiment, the third radiating conductive plate 17 is operated as the radiating element of the parasitic antenna by means of the electromagnetic coupling of the first shorting conductive plate 19 and the feeding conductive plate 14 when using the low band, such that two resonance points A and B can be generated when using the low band. Further, by suitably adjusting the degree of the electromagnetic coupling of the feeding conductive plate 14 and the first shorting conductive plate 19, it is possible to set two resonance points A and B which are most advantages for the broad band. As a result, it becomes easy to secure a desired bandwidth when using the low band even though a dual-band antenna is made to have small size and low height. Further, as is generally known, when using the high band, there is little an undesirable narrow bandwidth to be obtained even though a dual-band antenna is made to have small size and low height. Therefore, according to the dual-band antenna 11, it is possible to easily secure a bandwidth wider than a using frequency band to the respective signal waves of the high band and the low band, and it is possible to make a dual-band antenna have small size and low height without affecting the bandwidth. Further, in the dual-band antenna 11, the bent portion 15*a* is provided in an upper end of the second radiating conductive plate 15 to oppose the first radiating conductive plate 13, such that the first radiating conductive plate 13 functions as a capacitive load when using the high band, to thereby decreasing the electric field. Therefore, it is possible to drastically reduce the height of the second radiating conductive plate 15 less than a quarter of the resonant length. From this point, it is advantageous in a dual-band antenna having small size and low height. Further, the dual-band antenna 11 is a metallic plate product which can be easily formed by bending a conductive metallic plate, such that it is also advantageous in a manufacturing cost.

Figure 4:
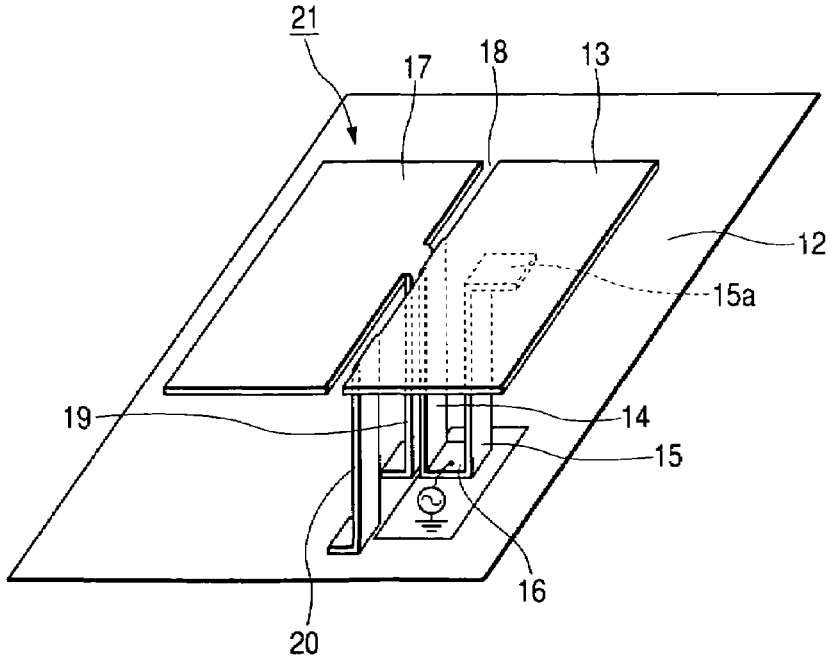
FIG. 4 is a perspective view showing a dual-band antenna according to a second embodiment of the present invention.

FIG. 4 is a perspective view a dual-band antenna according to a second embodiment of the present invention. The same reference numerals as those of the first embodiment represent like elements.

A dual-band antenna 21 according to the present embodiment is greatly different from the dual-band antenna 11 according to the first embodiment in that an impedance matching shorting conductive plate 20 for electrically shorting the first radiating conductive plate 13 to the surface of the grounding conductor 12 is additionally provided. The shorting conductive plate 20 extends approximately orthogonally from an outer edge of the first radiating conductive plate 13, whose lower end is connected to the surface of the grounding conductor 12. By suitably adjusting a forming position of the shorting conductive plate 20, it becomes easy to avoid impedance mismatching, such that it is possible to reduce the height of the entire antenna further.

Figure 5:
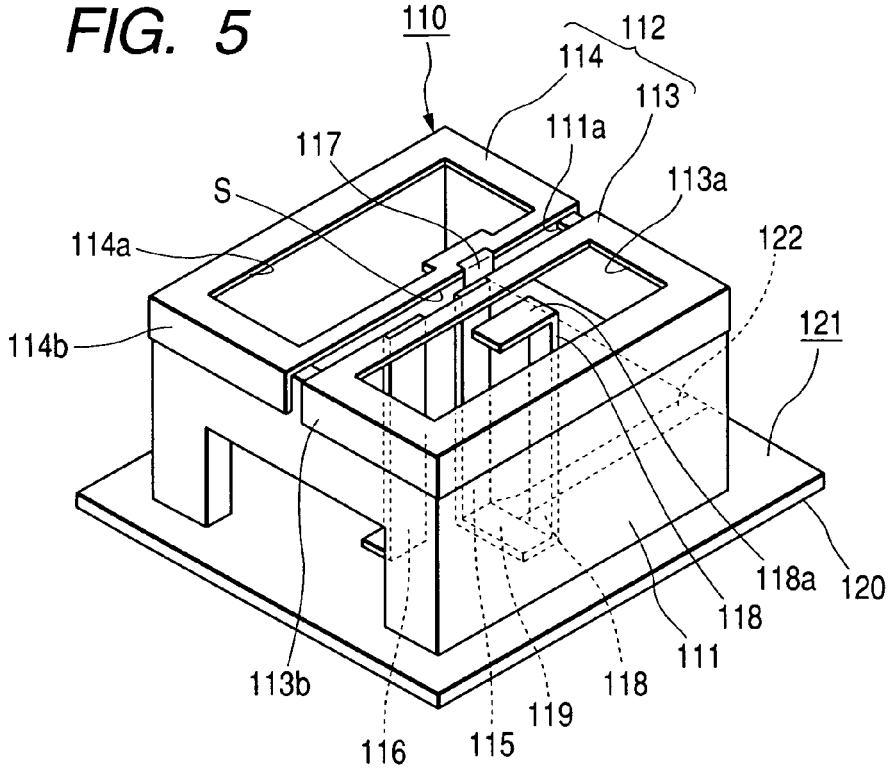
FIG. 5 is a perspective view showing a dual-band antenna according to a third embodiment of the present invention.
Figure 6:
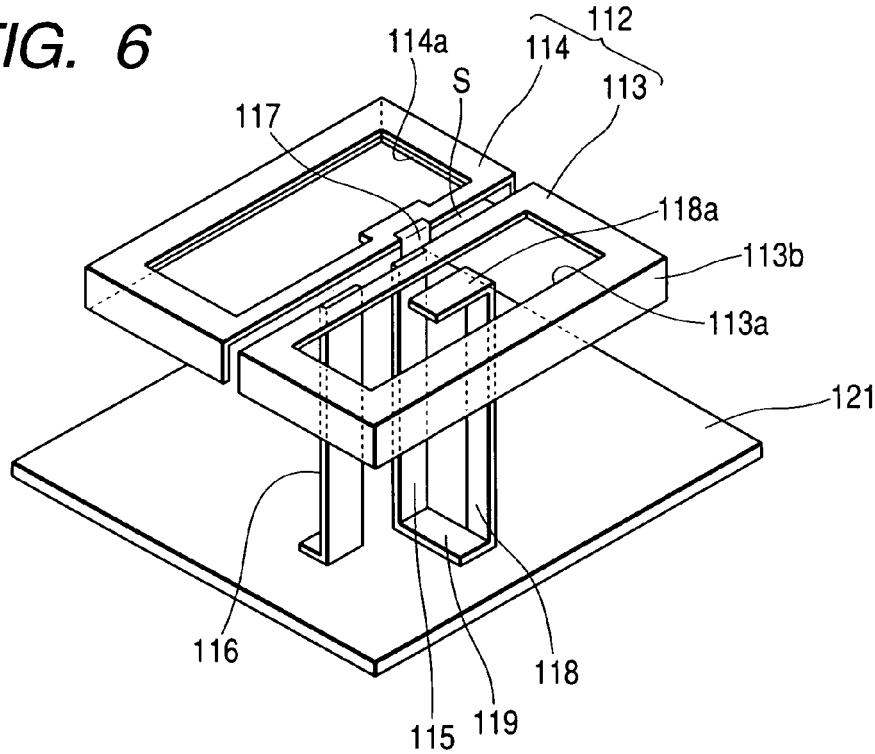
FIG. 6 is an explanatory view showing respective conductive plates of the dual-band antenna.
Figure 7:
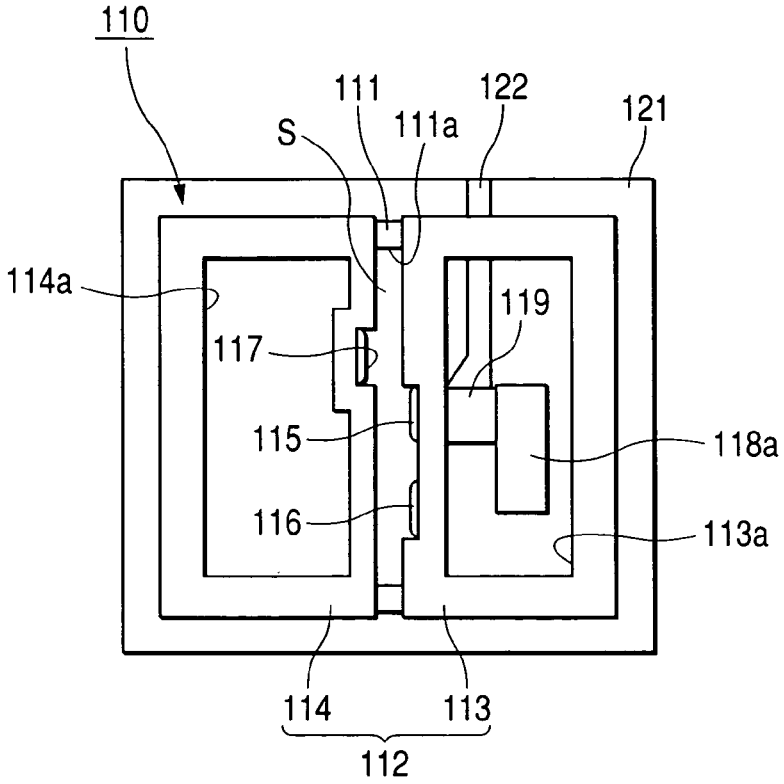
FIG. 7 is a plan view of the dual-band antenna.
Figure 8:
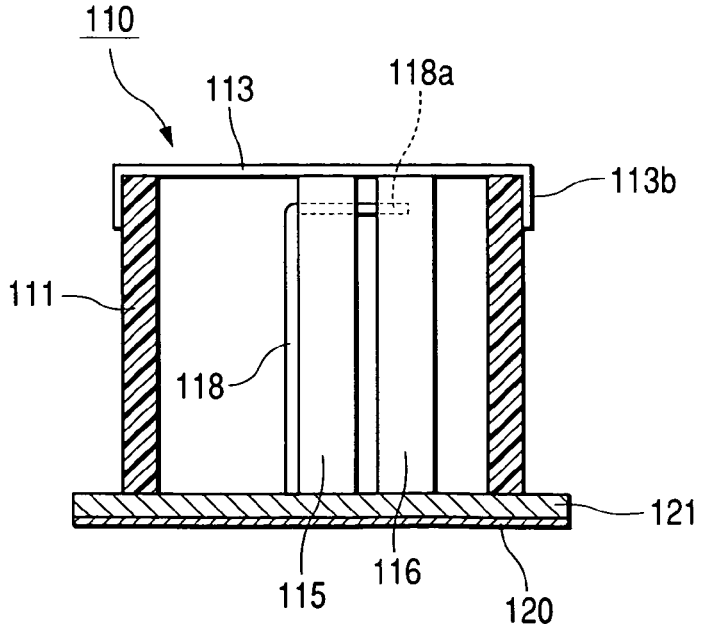
FIG. 8 is a longitudinal cross-sectional view along a slit of the dual-band antenna.
Figure 9:
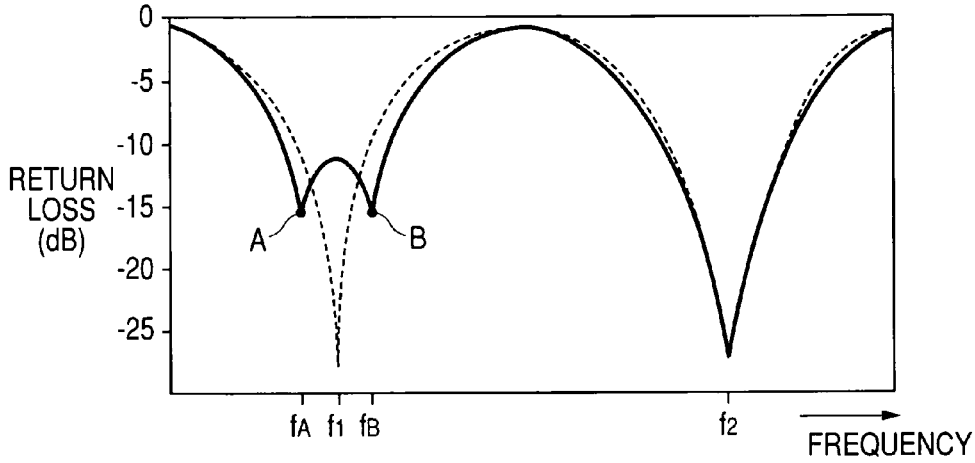
FIG. 9 is a characteristic view showing a return loss according to frequencies of the dual-band antenna.

FIG. 5 is a perspective view of a dual-band antenna according to a third embodiment of the present invention, FIG. 6 is an explanatory view showing respective conductive plates of the dual-band antenna, in which an insulating base member is not shown, FIG. 7 is a plan view of the dual-band antenna, and FIG. 8 is a longitudinal cross-sectional view along the slit of the dual-band antenna, and FIG. 9 is a characteristic view showing a return loss according to frequencies of the dual-band antenna.

A dual-band antenna 110 shown in FIGS. 5 to 9 is used for a vehicle antenna, and a small-sized antenna in which the transmission and the reception of signal waves of the low band (for example, AMPS band of 800 MHz) and the high band (for example, PCS band of 1.9 GHz) can be selectively performed. The dual-band antenna 110 schematically comprises a supporting substrate 121 with a grounding conductor 120 provided on an entire surface of the rear surface, an angled tube-shaped insulating base member 111 disposed on and fixed to the supporting substrate 121, a fourth radiating conductive plate 112 provided with a pair of divided conductive plates 113 and 114 with a slit S interposed therebetween and mounted at a position covering an opening end 111*a* of the insulating base member 111, a feeding conductive plate 115 and a second shorting conductive plate 116 provided in an inner space of the insulating base member 111, whose upper ends are connected to an outer edge of the divided conductive plate 113 adjacent to the slit S, a third shorting conductive plate 117 provided in the inner space of the insulating base member 111, whose upper end is connected to an outer edge of the divided conductive plate 114 adjacent to the slit S, and a fifth radiating conductive plate 118 provided in the inner space of the insulating base member 111, whose lower end is connected to the feeding conductive plate 115 and the height is lower than the fourth radiating conductive plate 112.

Here, the insulating base member 111 is a molded product made of a dielectric material such as synthetic resin, and four corners of the insulating base member 111 are fixed via screws from the rear surface of the supporting substrate 121. Further, the fourth and fifth radiating conductive plates 112 and 118, the feeding conductive plate 115, and the second and third shorting conductive plate 116 and 117 all are made of a conductive metallic plate such as a copper plate. The divided conductive plate 113, the feeding conductive plate 115, the second shorting conductive plate 116 and the fifth radiating conductive plate 118 are incorporated, and the divided conductive plate 114 and the third shorting conductive plate 117 are incorporated. That is, the feeding conductive plate 115 and the second shorting conductive plate 116 extend downward from the outer edge of the divided conductive plate 113, the fifth radiating conductive plate 118 extends upward via a bridge portion 119 from a lower end of the feeding conductive plate 115, and an upper end 118*a* of the fifth radiating conductive plate 118 extends in approximately parallel to the grounding conductor 120. Further, the third shorting conductive plate 117 extends downward from the outer edge of the divided conductive plate 114.

The pair of divided conductive plate 113 and 114 constituting the fourth radiating conductive plate 112 are respectively provided with windows 113*a* and 114*a*, and bent portions 113*b* and 114*b* protruded and extended along a circumferential edge of the opening end 111*a* of the insulating base member 111. The bent portions 113*b* and 114*b* are engaged with outer walls of the insulating base member 111 outwardly. The feeding conductive plate 115 extends from an approximately center of the outer edge of the divided conductive plate 113 adjacent to the slit S, and the second shorting conductive plate 116 extends in approximately parallel from a vicinity of the feeding conductive plate 115. The bridge portion 119 connecting a lower end of the feeding conductive plate 115 and a lower end of the fifth radiating conductive plate 118 is soldered to a feeding land on the supporting substrate 121, and the feeding land is connected to a feeding circuit (not shown) via a coplanar line 122. Further, lower ends of the second and third shorting conductive plates 116 and 117 are connected to the grounding conductor 120 via through holes which are provided in the supporting substrate 121. The third shorting conductive plate 117 is arranged to oppose obliquely the feeding conductive plate 115 via the slit S, and thus, when a power is supplied to the feeding conductive plate 115, a current flows through the third shorting conductive plate 117 by means of an electromagnetic coupling.

In such a dual-band antenna 110, by selectively supplying two types of high frequency powers in high and low bands having different frequencies to the bridge portion 119, it is possible to selectively excite the fourth radiating conductive plate 112 and the fifth radiating conductive plate 118. Here, when the fourth radiating conductive plate 112 is excited, the divided conductive plate 114 operates as a radiating element of a parasitic antenna. That is, by supplying a high frequency power of a first frequency $f_1$ for the low band to the feeding conductive plate 115, it is possible to allow the divided conductive plate 113 to be resonated like a radiating element of an inverted F type antenna. Further, since an induced current flows through the third shorting conductive plate 117 by means of the electromagnetic coupling with the feeding conductive plate 115, it is also possible to allow the divided conductive plate 114 to be resonated. In addition, by supplying a high frequency power of a second frequency $f_2$ (but, $f_2>f_1$) for the high band to the fifth radiating conductive plate 118, it is possible to allow the fifth radiating conductive plate 118 to be resonated as a monopole antenna.

Thus, a return loss (amount of radiation attenuation) according to frequencies of the dual-band antenna 110 becomes like a curve of solid line of FIG. 9, in which two different resonance points A and B in the low band are generated. Here, resonant frequencies corresponding to the resonance points A and B are determined according to relative positions of the feeding conductive plate 115 and the third shorting conductive plate 117, that is, the degree of the electromagnetic coupling of both conductive plates 115 and 117. Thus, if it is designed such that a return loss at a certain frequency between a resonant frequency f(A) corresponding to the resonance point A and a resonant frequency f(B) corresponding to the resonance point B becomes less than −10 dB by suitably selecting the relative positions of both conductive plate 115 and 117, and the difference of the resonant frequency f(A) and the resonant frequency f(B) is extremely enlarged, it is possible to drastically widen a bandwidth when using the low band, and further it is possible to suppress the narrow band due to the miniaturization further.

For example, in the case in which it makes the feeding conductive plate 115 and the third shorting conductive plate 117 extremely go near each other to strengthen the electromagnetic coupling remarkably, the resonant frequency f(A) and the resonant frequency f(B) become almost the same value, which results in narrowing the bandwidth. Meanwhile, if it makes both conductive plates 115 and 117 go away from each other to weaken the electromagnetic coupling, the difference of the resonant frequency f(A) and the resonant frequency f(B) is gradually increased, and also the bandwidth is widened accordingly. However, if the electromagnetic coupling of both conductive plates 115 and 117 is overly weakened, the return loss to signal waves of a predetermined frequency between the resonant frequency f(A) and the resonant frequency f(B) exceeds −10 dB, and thus a broad band cannot be obtained. Consequently, in the case in which the resonance points A and B as shown in FIG. 9 are set by suitably adjusting the degree of the electromagnetic coupling of the feeding conductive plate 115 and the third shorting conductive plate 118, a frequency range becomes maximum when the return loss is less than −10 dB, such that it is most advantageous in the broad band. Moreover, a curve of dotted line of FIG. 9 represents a return loss according to a comparative example in which the resonance point is just one in the low band. In this case, the bandwidth when using the low band is considerably narrowed as compared with the present embodiment. Further, since the bandwidth is widened as the resonant frequency is high, a bandwidth in the high band is sufficiently obtained as shown in FIG. 9.

Further, in the dual-band antenna 110, since the pair of divided conductive plates 113 and 114 constituting the fourth radiating conductive plate 112 are respectively provided with the windows 113*a* and 114*a*, currents to be supplied to the respective divided conductive plates 113 and 114 when using the low band flow along circumferential edges of the respective windows 113*a* and 114*a*, and thus it becomes easy to secure a desired resonant electric field without enlarging the respective divided conductive plates 113 and 114. Therefore, it is not required for the respective divided conductive plates 113 and 114 to form in a meandering shape in order to secure the resonant electric field, such that radiation efficiency is raised, and an effect of suppressing the narrow band due to the miniaturization is further raised.

Further, in the dual-band antenna 110, in the pair of divided conductive plates 113 and 114 constituting the fourth radiating conductive plate 112, currents having the same magnitude flowing in an opposite direction to each other are generated, and an electric field in one divided conductive plate and an electric field in the other divided conductive plate are cancelled each other. Therefore, while electric waves having a polarized wave direction parallel to the fourth radiating conductive plate 112 are almost never radiated, electric waves (vertical polarized waves) having a polarized wave direction orthogonal to the fourth radiating conductive plate 112 are intensively radiated as much, and thus uniformity of polarized waves is raised. Therefore, it is possible to enhance drastically gains of the vertical polarized waves required for the vehicle communication apparatuses. Moreover, since the fifth radiating conductive plate 118 for the high band operates as a monopole antenna when exciting, the gains of the vertical polarized waves are high.

Further, in the dual-band antenna 110, the upper end 118*a* of the fifth radiating conductive plate 118 extends in approximately parallel to the grounding conductor 120, and the fifth radiating conductive plate 118 operating as the monopole antenna is in a top loading state, such that it is possible to reduce the height to thus make a dual-band antenna have low height.

As described above, in the dual-band antenna 110 according to the present embodiment, it is possible to set two resonance points A and B which are most advantages for the broad band. As a result, when using the low band, there is little an undesirable narrow bandwidth to be obtained even though a miniaturization of an entire dual-band antenna is implemented. Further, as is generally known, when using the high band, there is little an undesirable narrow bandwidth even though a miniaturization of an entire dual-band antenna is implemented. Therefore, according to the dual-band antenna 110, it is possible to easily secure a bandwidth wider than a using frequency band to the respective signal waves of the high band and the low band, and it is possible to implement a miniaturization of an entire dual-band antenna without affecting the bandwidth. Further, in the dual-band antenna 110, the currents to be supplied to the pair of divided conductive plate 113 and 114 when using the low band respectively flow along the circumferential edges of the respective windows 113*a* and 114*a*, such that it is likely to secure a desired resonant electric field without forming the respective divided conductive plate 113 and 114 in a meandering shape, and thus an effect of suppressing the narrow band due to the miniaturization is further raised. In addition, when the dual-band antenna 110 is used for the low band, the electric fields are cancelled each other by means of the currents flowing in an opposite direction to each other, such that electric waves having a polarized wave direction orthogonal to the fourth radiating conductive plate 112 are intensively radiated. As a result, it is possible to drastically enhance the gains of the vertical polarized waves required for the vehicle communication apparatuses. Besides, the fifth radiating conductive plate 118 for the high band of the dual-band antenna 110 is in a top loading state by means of the upper end 118*a*, such that it is likely to drastically reduce the height to thus make a dual-band antenna have low height.

Moreover, if two resonance points A and B which are most advantageous in the broad band when using the low band, it is possible to miniaturize the entire dual-band antenna without affecting the bandwidth, even though the pair of divided conductive plates 113 and 114 constituting the fourth radiating conductive plate 112 are not provided with the windows 113*a* and 114*a*.

What is claimed is:

1. A dual-band antenna, comprising:

a first radiating conductive plate arranged to oppose a grounding conductor in an approximately parallel manner on a surface of the grounding conductor, the first radiating conductive plate being excited at a first frequency;

a feeding conductive plate extending approximately orthogonally from an outer edge of the first radiating conductive plate and connected to a feeding circuit;

a second radiating conductive plate extending in approximately parallel to the feeding conductive plate, whose lower end is connected to the feeding conductive plate and an upper end opposes a bottom surface of the first radiating conductive plate;

a third radiating conductive plate arranged to oppose a grounding conductor in an approximately parallel manner on a surface of the grounding conductor, the third radiating conductive plate being adjacent to the first radiating conductive plate with a slit interposed therebetween; and a first shorting conductive plate extending approximately orthogonally from an outer edge of the third radiating conductive plate and connected to the surface of the grounding conductor, wherein the second radiating conductive plate is excited at a second frequency which is higher than the first frequency, and the first shorting conductive plate is arranged close to the feeding conductive plate such that the first shorting conductive plate is electromagnetically coupled to the feeding conductive plate.

2. The dual-band antenna according to claim 1, wherein the feeding conductive plate extends from the outer edge of the first radiating conductive plate adjacent to the slit, and the first shorting conductive plate extends from the outer edge of the third radiating conductive plate adjacent to the slit.

3. The dual-band antenna according to claim 1, further comprising:

an impedance matching shorting conductive plate extending approximately orthogonally from the outer edge of the first radiating conductive plate and connected to the surface of the grounding conductor.

4. A dual-band antenna, comprising:

a cylindrical insulating base member mounted on a supporting substrate having a grounding conductor;

a first radiating conductive plate having a pair of divided conductive plates provided in parallel to a slit interposed therebetween and mounted at positions covering opening ends of the insulating base member;

a feeding conductive plate and a first shorting conductive plate provided in an inner space of the insulating base member, whose upper ends are respectively connected to an outer edge of one divided conductive plate of the pair of divided conductive plates adjacent to the slit;

a second shorting conductive plate provided in the inner space of the insulating base member, whose upper end is connected to an outer edge of the other divided conductive plate of the pair of divided conductive plates adjacent to the slit; and a second radiating conductive plate provided in the inner space of the insulating base member, whose lower end is connected to the feeding conductive plate and the height is lower than that of the first radiating conductive plate, wherein a lower end of the feeding conductive plate is connected to a feeding circuit and lower ends of the first and second shorting conductive plates are connected to the grounding conductor, such that in a state in which the second shorting conductive plate is electromagnetically coupled to the feeding conductive plate, the first radiating conductive plate is resonated at a first frequency, and the second radiating conductive plate is resonated at a second frequency which is higher than the first frequency.

5. The dual-band antenna according to claim 4, wherein the pair of divided conductive plates is respectively provided with windows which are approximately the same shape.

6. The dual-band antenna according to claim 4, wherein an upper end of the fifth radiating conductive plate extends in approximately parallel to the grounding conductor.

* * * * *

UNITED STATES PATENT AND TRADEMARK OFFICE

CERTIFICATE OF CORRECTION

PATENT NO. : 6,977,616 B2
DATED : December 20, 2005
INVENTOR(S) : Dou Yuanzhu

It is certified that error appears in the above-identified patent and that said Letters Patent is hereby corrected as shown below:

Column 14,
Line 2, before "radiating conductive" delete "fifth" and substitute -- second --.

Signed and Sealed this

Twenty-fifth Day of April, 2006

JON W. DUDAS
*Director of the United States Patent and Trademark Office*